United States Patent [19]

Kageyama et al.

[11] Patent Number: 4,737,266

[45] Date of Patent: Apr. 12, 1988

[54] METHOD FOR HYDROGENATING A SOLVENT-REFINED COAL

[75] Inventors: Yoichi Kageyama; Hironori Kageyama, both of Yokohama; Jun Imai, Sagamihara; Yukio Nakako, Takarazuka, all of Japan

[73] Assignees: Mitsubishi Chemical Industries Ltd., Tokyo; Kabushiki Kaisha Kobe Seiko Sho, Kobe; Idemitsu Kosan Company Limited, Tokyo; Asia Oil Company Limited, Tokyo; Nippon Brown Coal Liquefaction Co., Ltd., Tokyo, all of Japan

[21] Appl. No.: 564,189

[22] Filed: Dec. 22, 1983

[30] Foreign Application Priority Data

Dec. 28, 1982 [JP] Japan ..... 57-234541

[51] Int. Cl.[4] ..... C10G 1/06; C10G 45/00

[52] U.S. Cl. ..... 208/423; 208/422; 208/142; 208/143

[58] Field of Search ..... 208/8 LE, 10, 142, 143

[56] References Cited

U.S. PATENT DOCUMENTS

| | | | |
|---|---|---|---|
| 3,228,871 | 1/1966 | Schlinger | 208/143 X |
| 4,079,004 | 3/1978 | Tan et al. | 208/8 LE X |
| 4,081,358 | 3/1978 | Tan et al. | 208/8 LE |
| 4,081,359 | 3/1978 | Gatsis et al. | 208/8 LE |
| 4,255,248 | 3/1981 | Rosenthal et al. | 208/10 X |
| 4,264,429 | 4/1981 | Rosenthal et al. | 208/10 |
| 4,371,727 | 2/1983 | Gavin | 208/143 X |
| 4,461,694 | 7/1984 | Givens et al. | 208/8 LE |

*Primary Examiner*—Helen M. S. Sneed
*Assistant Examiner*—William G. Wright
*Attorney, Agent, or Firm*—Oblon, Fisher, Spivak, McClelland & Maier

[57] ABSTRACT

A method for hydrogenating a solvent-refined coal by heating it under hydrogen pressure in a fixed bed, characterized in that a solvent-refined coal fraction containing no substantial amount of preasphaltene is used as the solvent-refined coal.

12 Claims, No Drawings

METHOD FOR HYDROGENATING A SOLVENT-REFINED COAL

The present invention relates to a method for hydrogenating a solvent-refined coal obtained by treating coal with a solvent, thereby to convert the solvent-refined coal into a liquid substance. More particularly, the present invention relates to a method for converting a solvent-refined coal fraction containing no substantial amount of preasphaltene into a liquid hydrocarbon oil by heating it under hydrogen pressure in a fixed bed.

In view of the recent unfavorable situation surrounding energy and resources, it is desired to develop a liquid fuel which can be substituted for petroleum. In view of abundant coal reserves, it is particularly important to establish a technique for liquefying coal.

In general, petroleum is a liquid composed mainly of aliphatic hydrocarbon compounds, whereas coal has a small ratio of hydrogen to carbon, as compared with petroleum, and it is a solid substance composed mainly of condensed aromatic compounds. However, when coal is treated with high pressure hydrogen together with a hydrocarbon solvent, preferably a solvent having a high hydrogen donative property, at a high temperature in the presence or absence of a catalyst, a part of the condensed aromatic compounds will be hydrogenated, whereby the coal becomes soluble in a solvent.

Such a method for liquefying coal is usually called a solvent-refining method. If the reaction solution obtained by the treatment is distilled, liquefied light oil is obtainable as a distillate together with the solvent thereby recovered. Whereas, as the distillation residue, carbonaceous material which is solid at room temperature and which is called a solvent-refined coal, is obtained. Such a solvent-refined coal has a boiling point of at least 400° C. under atmospheric pressure, and it melts when heated to a temperature of about 150° C.

The solvent-refined coal thus obtained is soluble in a solvent such as quinoline in its major portion. However, it still contains insoluble components such as a carbonaceous substance insoluble in the solvent and an ash content present in the starting material coal, or a catalyst in the case where the catalyst is used in a suspension bed system. These insoluble components may usually be removed from the solvent-refined coal by a method such as sedimentation separation. The solvent-refined coal may be used by itself as a fuel, but it may also be used as a carbon material such as a substitute for caking coal for coke.

In order to obtain a liquefied oil in high yield in the above-mentioned solvent-refining liquefaction method wherein coal is subjected together with a solvent to hydrogenation treatment to obtain the solvent-refined coal and the liquefied oil, it is conceivable to facilitate the hydrogenolysis of the solvent-refined coal into the liquefied oil by employing severe reaction conditions. However, by such a method, it is likely that the resulting liquefied oil undergoes further decomposition and gasification, whereby the yield of the liquefied oil rather tends to decrease.

As a method to avoid this problem, there is a method wherein the resulting solvent-refined coal is separated from the liquefied oil, and then the solvent-refined coal is again subjected to hydrogenation treatment to convert it into a liquefied oil.

It is well known that a catalyst composed of a combination of cobalt, nickel, molybdenum, tungsten, etc., or red mud, iron ore, etc. comprising iron as the main component, is effective in the hydrogenation treatment of such a solvent-refined coal.

However, the solvent-refined coal as the feed material contains highly unsaturated polycondensation products or ash contents which deactivate the catalyst. Accordingly, if the solvent-refined coal itself is used for the hydrogenation treatment, it is difficult to maintain the catalytic activity for a long period of time even when a catalyst composed of expensive components such as cobalt, nickel, molybdenum or tungsten is used. On the other hand, if a catalyst comprising inexpensive and abundantly available iron as the major component, is used instead of the catalyst composed of the above-mentioned expensive components, the catalytic activity will be considerably inferior as compared with the catalyst composed of cobalt, nickel, molybdenum or tungsten, whereby the yield of the liquefied oil will be low.

Under the circumstances, the present inventors have made extensive study to find out the causes for the deactivation of the catalyst and to find out a method for prolonging the catalytic activity of the highly active catalyst composed of cobalt, nickel, molybdenum or tungsten, and have found that the solvent-refined coal obtained by a conventional deasphalting operation still contains a substantial amount of preasphaltene components, and such preasphaltene components are the major factor for the deactivation of the catalyst, and that by using a solvent-refined coal fraction containing no substantial amount of preasphaltene components, it is possible to maintain the catalytic activity for an extended period of time even when the catalyst composed of such expensive components is used, whereby the yield of the liquefied oil can be increased over the case where the solvent-refined coal is employed by itself. The present invention has been accomplished based on these discoveries.

Thus, the present invention provides a method for hydrogenating a solvent-refined coal by heating it under hydrogen pressure in a fixed bed, characterized in that a solvent-refined coal fraction containing no substantial amount of preasphaltene is used as the solvent-refined coal.

Now, the present invention will be described in detail with reference to the preferred embodiments.

In the present invention, it is preferred to use a solvent-refined coal which is obtained under such conditions that a coal such as brown coal, sub-bituminous coal or bituminous coal is treated together with a hydrocarbon solvent in the presence or absence of a catalyst under hydrogen pressure of from 100 to 300 $kg/cm^2$ at a temperature within a range of from 350 to 500° C. for from 0.1 to 2 hours. As the method for obtaining the fraction containing no substantial amount of preasphaltene components, it is possible to employ a method wherein the difference in the solubility to a solvent is utilized, a method such as liquid chromatography wherein the difference in the chemical structural characteristics is utilized or a distillation method. More specifically, it is possible to use extraction separation by means of an aromatic solvent such as benzene or toluene, or distillation.

The preasphaltene in the present invention is defined to be a substance which is soluble in pyridine, quinoline or tetrahydrofuran and is insoluble in benzene or toluene, as described in a known literature (e.g. "CATALYST" volume 22, pages 60 and 71).

In the present invention, a solvent-refined coal fraction containing no substantial amount of such preasphaltene is used. Here, the term "containing no substantial amount" means that the preasphaltene content in the fraction is minimized to a level of e.g. at most 10% by weight. It is advantageous that in the removal of the preasphaltene, an ash content will usually be simultaneously removed. In usual deasphalting operation to obtain a solvent-refined coal, it is common to use a solvent such as benzene. It has been believed to be difficult or uneconomical to completely separate solvent insoluble components by filtration on an actual commercial scale although such complete separation may be possible by a laboratory scale operation. The present inventors have found that almost all solvent-refined coals usually contain as much as 30% by weight of preasphaltene, that such a substantial amount of preasphaltene gives rise to a fatal hindrance in the operation of a fixed bed hydrogenation reaction of the solvent-refined coal, and that contrary to the conventional belief, the operation to remove preasphaltene together with an ash content at the time of the above deasphalting is quite easy even on a commercial scale as compared with such a fatal difficulty. Thus, when the present invention is applied to a so-called two step hydrogenation to obtain a liquefied oil by subjecting coal, particularly a low grade coal such as brown coal, to primary hydrogenation, deasphalting and secondary hydrogenation, and a system is employed wherein substantially all of the preasphaltene is removed from the primary hydrogenation reaction product simultaneously with or subsequent to the deasphalting, it is thereby possible to realize a combination of process steps which provides extremely good efficiency as a whole.

The catalyst to be used in the present invention may be prepared by having cobalt nitrate, nickel nitrate, ammonium molybdate or ammonium tungstate supported on a commercially available carrier such as alumina or silica alumina, or a solid acid such as alumina prepared from boehmite, followed by sintering, and prior to its use, the catalyst is further modified with sulfur by means of hydrogen sulfide or carbon disulfide. It is also possible to use catalysts which are commonly employed for the desulfurization of the residual oils of petroleum. The reaction of the hydrogenation treatment of the solvent-refined coal is usually conducted by a fixed bed system wherein the catalyst is fixed.

As the solvent to be used in the present invention, it is preferred to use heavy oils from coal recovered from the liquefying process, for instance those having a boiling point of at least 180° C. However, other solvents which are commonly used in the liquefaction of coal may also be employed, such as heavy oils or coal obtained from other process steps or heavy oils obtained from petroleum.

The reaction temperature in the present invention is preferably from 330° to 450° C. The reaction time is preferably from 0.1 to 5 hours. Likewise, the hydrogen partial pressure is preferably from 50 to 300 kg/cm$^2$, and the weight ratio of the solvent to the solvent-refined coal is preferably from 0.1 to 10. However, the reaction conditions are optionally selected depending upon the nature of the fraction containing no substantial amount of preasphaltene or the nature of the desired liquefied oil, and thus have no particular restrictions.

From the foregoing description, it should be apparent that the present invention has made it possible to obtain liquefied oil from the solvent-refined coal by utilizing the feature of the high catalytic activity of an expensive catalyst without deactivating the catalyst. Thus, the industrial value of the invention is substantial.

Further, it has been found by some of the inventors that when the preasphaltene stream separated from the solvent-refined coal is recycled to the primary hydrogenation reaction zone for the preparation of the solvent-refined coal from coal, it is possible not only to convert the preasphaltene stream to a useful material and minimize the loss of the material, but also to realize a highly efficient process for the liquefaction of coal which provides an extremely high overall oil yield. Thus, the present invention includes such effective utilization of the preasphaltene stream. In this case, the amount of the preasphaltene stream recycled to the primary hydrogenation zone is from 0.1 to 30 times by weight, preferably from 0.2 to 20 times by weight, relative to the amount by weight of the anhydrous ashless coal.

Now, the present invention will be described in further detail with reference to Examples. However, it should be understood that the present invention is by no means restricted by these specific Examples.

EXAMPLE 1

Morwell coal produced in Australia was subjected to liquefaction at a reaction temperature of 430° C. under hydrogen pressure of 150 kg/cm$^2$ for a reaction time of 2 hours by using iron ore as the catalyst, to obtain an ash-free solvent-refined coal containing 33.3% by weight of preasphaltene. The solvent-refined coal was extracted with hot benzene to obtain a fraction containing no substantial amount of preasphaltene (bp 420° C./760 mmHg, C: 85.6%, H: 6.7%, N: 1.0%, S: 0.1%, 0: 6.6%). The fraction was mixed with the solvent (bp: 180°–420° C./760 mmHg) used in the hydrogenation treatment of Morwell coal in a weight ratio of 1 : 2. The mixture was passed through a fixed bed reaction apparatus packed with a catalyst composed of cobalt and molybdenum (Co content: 3.1% by weight, Mo content: 8.3% by weight) supported on alumina, at a reaction temperature of 365° C. under hydrogen pressure of 230 kg/cm$^2$ at a liquid space velocity of 0.5 hr$^{-1}$. In the initial stage of the reaction, the conversion and the yield of liquefied oil represented by the following formulas were 21% and 8.5%, respectively. Further, after the reaction for 500 hours, the conversion and the yield of liquefied oil were also 21% and 8.5%, respectively.

$$\text{Conversion (\%)} = \left[1 - \frac{\text{Recovered solvent-coal (g/hr)}}{\text{Feed solvent-refined coal (g/hr)}}\right] \times 100$$

$$\text{Yield of liquefied oil (\%)} = \frac{\text{Liquefied oil produced (g/hr)}}{\text{Feed solvent-refined coal (g/hr)}} \times 100$$

EXAMPLE 2

The same feed material as used in Example 1 was used, and the experiment was conducted by the same reaction apparatus under the same reaction conditions except that the catalyst was changed to a catalyst comprising nickel and tungsten supported on alumina (Ni content: 4.0% by weight, W content: 16% by weight). In the initial stage of the reaction, the conversion and the yield of liquefied oil were 20% and 8.2%, respectively. Further, after the reaction for 500 hours, the conversion and the yield of liquefied oil were also 20% and 8.2%, respectively.

COMPARATIVE EXAMPLE 1

By using the same feed material and reaction apparatus as in Example 1, the experiment was conducted under the same condition as in Example 1 except that the ash-free solvent refined coal (bp 420° C./760 mmHg, C: 84.4%, H: 6.4%, N: 1.1%, S: 0.2%, 0: 7.9%) obtained from Morwell coal, was used as it was.

In the initial stage of the reaction, the conversion and the yield of liquefied oil were 17% and 5%, respectively. After the reaction for 500 hours, the conversion and yield of liquefied oil were as low as 2% and 4%, respectively.

We claim:

1. A method for hydrogenating a solvent refined coal, comprising:

(a) hydrogenating coal in the presence of a hydrocarbon solvent and an iron catalyst selected from the group consisting of red mud and iron ore (b) obtaining a solvent-refined coal material therefrom which has a boiling point of at least 400° C. under atmospheric pressure conditions;

(c) removing preasphaltenes from said solvent-refined coal material to the extend of obtaining a substantially preasphaltene free solvent-refined coal; and (d) hydrogenating the solvent-refined coal in a fixed bed under hydrogen pressure.

2. The method according to claim 1, wherein the preasphaltene content in the solvent-refined coal ranges from 0 to 10% by weight.

3. The method according to claim 1, wherein the presaphaltene content in the solvent-refined coal ranges from 0 to 5% by weight.

4. The method according to claim 1, wherein the hydrogenation of step (d) is conducted in the presence of a catalyst containing at least one catalytically active component selected from the group consisting of cobalt, nickel, molybdenum and tungsten.

5. The method according to claim 4, wherein the catalytically active component is supported on a carrier selected from the group consisting of alumina, silica and silica-alumina.

6. The method according to claim 4, wherein said catalyst is modified by sulfur.

7. The method according to claim 1, wherein the hydrogenation is conducted at a temperature of from 330 to 450° C. under hydrogen partial pressure of from 50 to 300 kg/cm$^2$.

8. A two step hydrogenation process for producing oil form coal, comprising:

(a) hydrogenating coal in the presence of a solvent and an iron catalyst selected from the group consisting of red mud and ion ore (b) obtaining a solvent refined coal material therefrom which has a boiling point of at least 400° C. under atmospheric pressure conditions;

(c) removing preasphaltenes from said solvent-refined coal material down to a level of at most 10% by weight of the original preasphaltene content;

(d) hydrogenating the substantially preasphaltene free solvent-refined coal in the presence of a fixed bed catalyst at a temperature of from 330° C. to 450° C. under a hydrogen partial pressure of from 50 to 300 kg/cm$^2$; and (e) recovering oil from the hydrogenated reaction product.

9. The process according to claim 8, wherein the removal of the preasphaltene material is conducted simultaneously with the removal of the ash content of the solvent-refined coal material.

10. The process according to claim 8, wherein the removal of the preasphaltene material is conducted by treating the solvent-refined coal with benzene, toluene or mixtures thereof.

11. The process according to claim 8, wherein the coal is brown coal.

12. The process according to claim 8, wherein the preasphaltene content in the solvent-refined coal is from 0 to 15% by weight.

* * * * *